US007012566B2

(12) United States Patent
Lee et al.

(10) Patent No.: US 7,012,566 B2
(45) Date of Patent: Mar. 14, 2006

(54) DYNAMIC ORIENTATION ADJUSTING DEVICE FOR SATELLITE ANTENNA INSTALLED IN MOVABLE CARRIER

(75) Inventors: Chien-Chung Lee, Dais Township, Taoyuan County (TW); Juyang Chang, Dali (TW)

(73) Assignee: Mitac Technology Corp., Hsien (TW)

( * ) Notice: Subject to any disclaimer, the term of this patent is extended or adjusted under 35 U.S.C. 154(b) by 0 days.

(21) Appl. No.: 11/062,871

(22) Filed: Feb. 23, 2005

(65) Prior Publication Data

US 2005/0248486 A1 Nov. 10, 2005

(30) Foreign Application Priority Data

May 6, 2004 (TW) ..... 93112749 A

(51) Int. Cl.
*H01Q 3/00* (2006.01)

(52) U.S. Cl. ..... 342/359

(58) Field of Classification Search ..... 342/75, 342/359, 422; 343/754, 757
See application file for complete search history.

(56) References Cited

U.S. PATENT DOCUMENTS

| | | | | |
|---|---|---|---|---|
| 4,994,812 | A * | 2/1991 | Uematsu et al. | 342/359 |
| 5,073,783 | A * | 12/1991 | Uematsu et al. | 342/359 |
| 6,191,734 | B1 * | 2/2001 | Park et al. | 342/359 |
| 2005/0093743 | A1 * | 5/2005 | Park et al. | 342/359 |

* cited by examiner

*Primary Examiner*—Dao Phan
(74) *Attorney, Agent, or Firm*—Rosenberg, Klein & Lee

(57) ABSTRACT

Disclosed is a device for dynamically adjusting orientation of a satellite antenna carried in a movable carrier, including a satellite tracking system and an adjusting device. The satellite tracking system includes a position processor that receives an electromagnetic signal from at least one satellite and retrieve from the electromagnetic signal a satellite coordinate, a comparator comparing the satellite coordinate with a pre-set target coordinate to generate an error, and a microprocessor processing the error to issue a control signal that is fed to the adjusting device for changing orientation of the antenna to match with that of the satellite.

13 Claims, 3 Drawing Sheets

DYNAMIC ORIENTATION ADJUSTING DEVICE FOR SATELLITE ANTENNA INSTALLED IN MOVABLE CARRIER

FIELD OF THE INVENTION

The present invention relates generally to a control device for adjusting the orientation of a satellite disc antenna, and in particular to a control device that adjusts the orientation of a satellite disc antenna carried by a moving carrier, such as a vehicle, so as to make the constantly point at satellites located at predetermined positions.

BACKGROUND OF THE INVENTION

Global positioning system (GPS) is widely used in a variety of applications, such as automobile navigation, geographic survey, satellite television program, satellite broadcasting, satellite communication, and military applications. The general function of the global positioning system is detection of the position, namely coordinates, of an object, which may be moving or maintains fixed, and calculation of distance, time, velocity and altitude of the object. Such data are of importance use in a variety of applications, which means the global positioning system is getting broader applications.

Development of the global positioning system has made a great progress in a number of applications. For example, U.S. Pat. No. 6,680,694 discloses a GPS based vehicle information system, comprising an in-vehicle system that communicates with a centralized server system via a wireless communication link. A user may specify a destination to the in-vehicle system, which transmits the specification of the destination to the centralized server system. The server system computes a route to the destination and transmits the computed route back to the in-vehicle system. The in-vehicle system may then guide the user to drive along the route.

Another example is illustrated in U.S. Pat. No. 6,690,323, which discloses a GPS receiver having emergency communication channel. When a normal GPS communication channel is interfered with, the communication of the GPS receiver can be maintained by switching to the emergency channel.

A further example is U.S. Pat. No. 6,633,814, which discloses a GPS system for navigating a vehicle, comprising vehicle carried receiver that receives a GPS signal to perform vehicle navigation based on pre-established maps and route information.

One further example is shown in U.S. Pat. No. 6,671,587, which discloses a vehicle dynamic measuring apparatus and a method using multiple GPS antennas. To realize vehicle dynamic measurement and determination of velocity, two GPS receiving antennas are installed in a vehicle and a controller is employed to detect change in carrier frequency.

When people watch TV programs or listen to radio programs in a moving vehicle, the electromagnetic waves that carry the programs are received by a frequency based receiver carried in the vehicle. In other words, the program can be correctly received once the receiver in tuned to the frequency of the electromagnetic waves that carry the program. Since the electromagnetic waves are generally omnidirectional, an antenna can receives the waves without being set in a specific direction.

However, an electromagnetic signal that carries a satellite program is directional, which can be received by an antenna oriented in a particular direction. This makes it difficult to receive the satellite program in a moving vehicle for the direction is constantly changed. Thus, generally speaking, a conventional satellite program receiving device that is generally designed for use on fixed location cannot effectively and clearly receive the satellite program in a moving vehicle.

Past development of the GPS techniques, such as those discussed above, does not provide a solution for clearly receiving satellite program in a moving vehicle. The present invention is thus aimed to provide a solution for such a problem.

SUMMARY OF THE INVENTION

An objective of the present invention is to provide a dynamic adjustment control device for a satellite antenna carried in a moving carrier, which tracks the current position of a satellite with respect to the carrier, determines an error of the position of the satellite due to the movement of the carrier, and adjusting, based on the error, the orientation of the antenna to clearly receive electromagnetic signals from the satellite.

To realize the objective, the present invention provides a device that is capable of dynamic adjustment of the orientation of an antenna carried by a moving vehicle to obtain an optimum reception of satellite program. The control device comprises a satellite coordinate tracking device and an antenna adjusting mechanism. The satellite coordinate tracking device comprises a GPS position processor, which processes an electromagnetic signal received from a satellite to obtain current coordinate of the satellite and compares the current satellite coordinate with a target coordinate that is retrieved from a target coordinate register. An error is generated, if the current coordinate is different from the target one. The error is fed to a microprocessor, which provides a correction signal corresponding to the error. The correction signal is fed to an adjusting mechanism to reorient the antenna to match the coordinate of the satellite.

Three coordinates, including longitude, latitude, and altitude of a satellite, are used to adjust the antenna with respect to the particular satellite. The dynamic adjusting device of the present invention allows for adjustment of the orientation of the antenna that is carried in a moving vehicle to match the longitude, latitude, and altitude of the satellite with respect to the moving vehicle, which in turn realizes an optimum reception of electromagnetic signals transmitted from the satellite by an in-vehicle receiver and clear display of the programs carried by the electromagnetic signals, regardless the moving of the vehicle.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF PREFERRED EMBODIMENT

Figure 1:
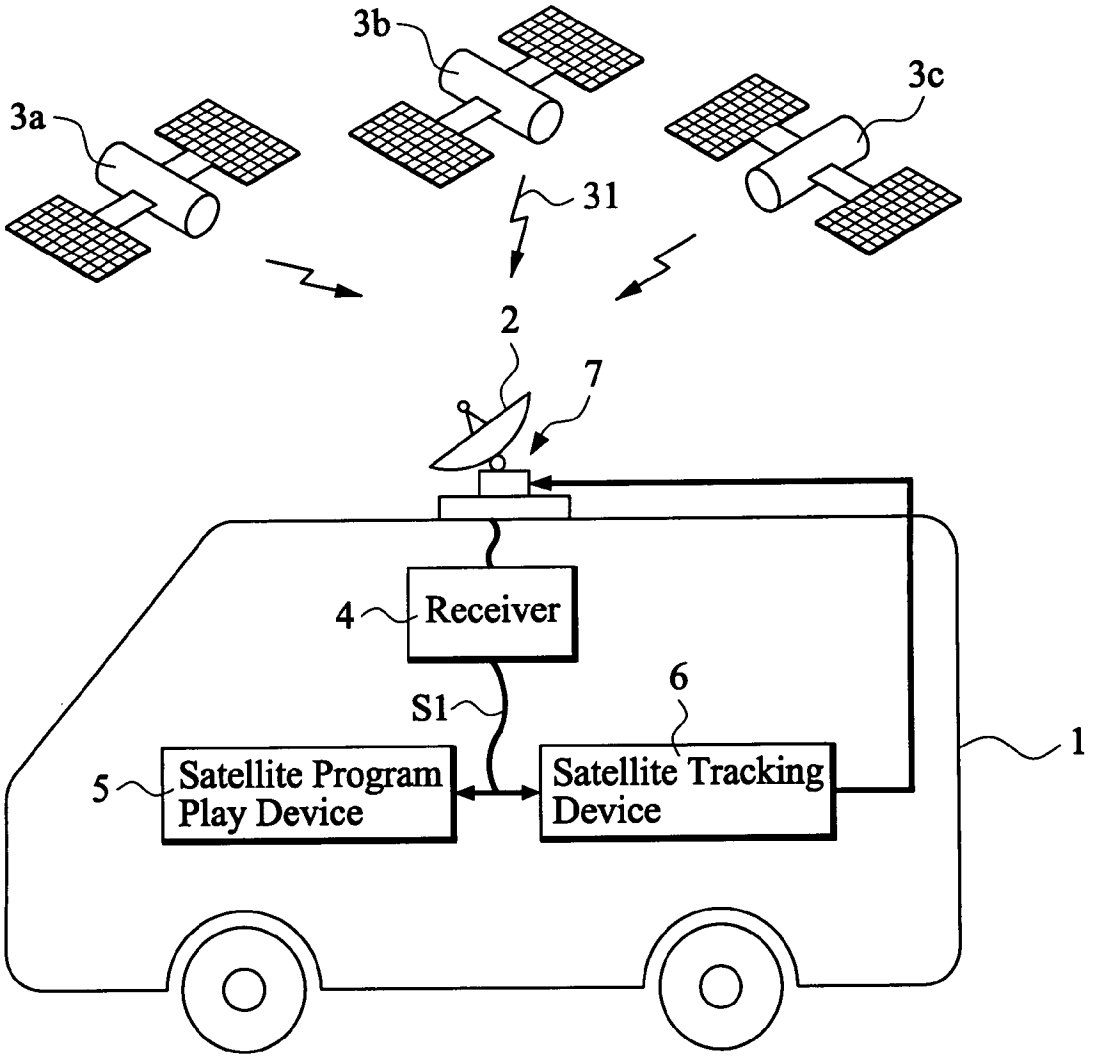
FIG. 1 is a schematic view illustrating a dynamic adjusting device for satellite antenna carried in a vehicle in accordance with the present invention.

With reference to the drawings and in particular to FIG. 1, a dynamic adjustment control device constructed in accordance with the present invention is shown, which is provided for controlling the adjustment of orientation of a satellite antenna, generally designated with reference numeral 2, mounted in/on a movable carrier, such as a moving vehicle 1. Three satellites 3*a*, 3*b*, 3*c* that are located at predetermined positions transmit electromagnetic signals 31, which are received by a receiver 4 via a satellite disc antenna 2, both the satellite disc antenna 2 and the receiver 4 being installed in the vehicle 1. The electromagnetic signals 31 transmitted from the satellite 3*a*, 3*b*, 3*c* carry programs that can be displayed on for example a TV set or can be broadcast through a radio or the likes. The satellites 3*a*, 3*b*, 3*c* plays two roles of which the first one is to do global positioning of the vehicle 1 and the second one is to each transmit programs in different channels.

The electromagnetic signal 31 that is transmitted from the satellites 3*a*, 3*b*, 3*c* is received by the receiver 4 via the antenna 2 and the receiver 4 generates a satellite signal S1 corresponding to the received electromagnetic signal 31. The satellite signal S1 generated by the receiver 4 is comprised of a video component, an audio component, and a coordinate component, all obtained by processing the electromagnetic signal 31. In other words, these components are all carried and transmitted by the electromagnetic signal 31. The satellite signal S1 is fed to a satellite program play device 5, which may then play a satellite program composed of the video and audio components.

In a preferred embodiment of the present invention, a satellite tracking device 6 is provided in the vehicle 1 and electrically coupled to the receiver 4 to receive the coordinate component of the satellite signal S1 and also electrically coupled to an antenna adjusting device 7, which receives a control signal from the satellite tracking device for adjusting the orientation of the antenna 2 in order to dynamically track the satellites 3*a*, 3*b*, 3*c* and cooperates with an antenna adjustment mechanism 7 and thus realizing the best reception of the electromagnetic signal 31 from the satellites 3*a*, 3*b*, 3*c* by the antenna 2.

Figure 2:
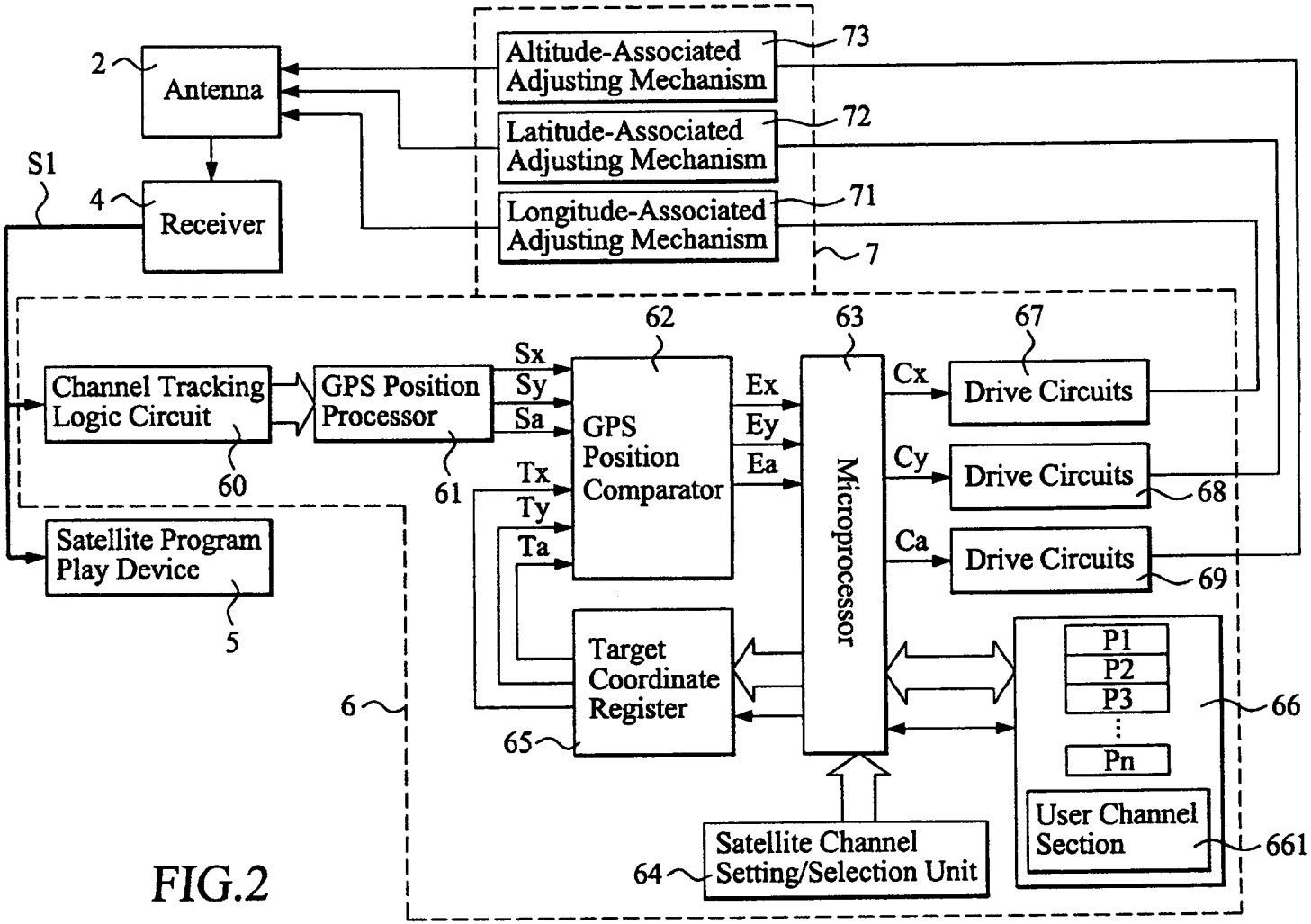
FIG. 2 is a block diagram of a control circuit of the dynamic adjusting device in accordance with the present invention.

Also referring to FIG. 2, a circuit of the control device in accordance with the present invention is shown. In addition to the play device 5, the satellite signal S1 generated by the receiver 4 is applied to the satellite tracking device 6 in which the coordinate component is retrieved and analyzed. The satellite tracking device 6 comprises a channel tracking logic circuit 60, which receives the satellite signal S1 and in turn provides a signal to a GPS position processor 61 in which the coordinate component is retrieved from the satellite signal S1 and processed to provide for example satellite longitude Sx, satellite latitude component Sy, and satellite altitude Sa.

The satellite longitude Sx, satellite latitude Sy, and satellite altitude Sa are then fed to a first set of inputs of a GPS position comparator 62. The GPS position comparator 62 has a second set of inputs that receive target longitude Tx, target latitude Ty, and target altitude Ta from a target coordinate register 65. The target longitude Tx, target latitude Ty, and target altitude Ta are stored in the target coordinate register 65 and are set by a user in advance via a satellite channel setting/selection unit 64. The user may select a favorite channel via the satellite channel setting/selection unit 64, which provides and stores the associated target longitude Tx, target latitude Ty, and target altitude Ta in the register 65.

In addition, a number of satellite program channels P1, P2, P3, . . . , Pn may be preset in a channel memory 66 in the factory site when the device is manufactured or later by a user. This allows the user to readily select one of the program channels P1–Pn from the channel memory 66 via the satellite channel setting/selection unit 64. Target longitude, target latitude, and target altitude associated with the selected channel P1–Pn can be retrieved from data stored in the channel memory 66 or obtained by processing the data from the channel memory 66. Such longitude, latitude, and altitude are then transferred to the target coordinate register 65 from which the target longitude, target latitude, and target altitude are conveyed to the GPS position comparator 62.

The memory 66 selectively comprises a user channel section 661 in which a user's personal favorite channel can be set and stored by the user via the satellite channel setting/selection unit 64. Date stored in the user channel section 661 of the memory 66 may be quickly retrieved by the user and processed and transferred to the target coordinate register 65.

The GPS position comparator 62 performs a comparison between the satellite longitude Sx, satellite latitude Sy, and satellite altitude components Sa received from the satellites 3*a*, 3*b*, 3*c* and the target longitude Ta, target latitude T, and target altitude Ta received from the target coordinate register 65 and generates longitude error Ex, latitude error Ey, and altitude error Ea, which are fed to a microprocessor 63. Based on the errors Ex, Ey, Ea, a longitude correction control signal Cx, a latitude correction control signal Cy, and an altitude correction control signal Ca are calculated by the microprocessor 63 and respectively applied to first, second, and third drive circuits 67, 68, 69, which in turn control the operation of a first, longitude-associated adjusting mechanism 71, a second, latitude-associated adjusting mechanism 72, and a third, altitude-associated adjusting mechanism 73, which constitute the antenna adjusting device 7 and are mechanically coupled to the antenna 2 for re-orienting the antenna 2 toward for example the satellite 3*a* to receive a desired program channel transmitted by the satellite 3*a*.

The adjusting mechanisms 71, 72, 73 can be any known mechanism for moving the antenna 2, such as that comprising a rotatable table rotated by gear train driven by a servo motor or stepping motor. This is well known and thus no further detail is necessary herein.

Figure 3:
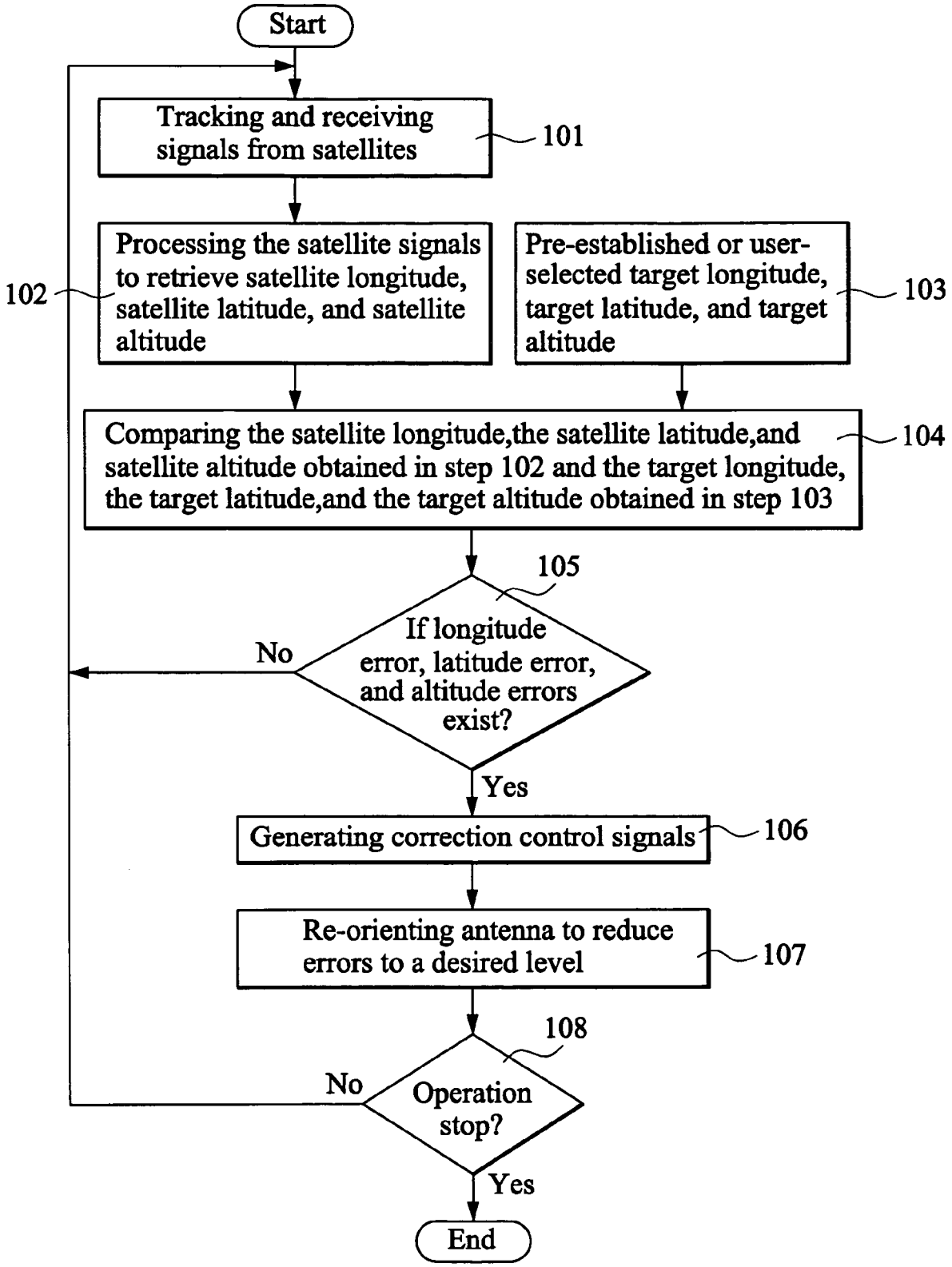
FIG. 3 is a flowchart illustrating orientation adjustment of a satellite antenna carried in a moving vehicle for tracking a satellite.

Also referring to FIG. 3, the operation of the control device in accordance with the present invention will be briefly described. In step 101, the control device of the present invention tracks and receives the electromagnetic signals 31 from the satellites 3*a*, 3*b*, 3*c*. The electromagnetic signals 31 are the processed to retrieve the satellite longitude Sx, the satellite latitude Sy, and the satellite altitude Sa (step 102). On the other hand, in step 103, the user selects one of a number of pre-established program channel or simply sets a program channel of which the target longitude Tx, the target latitude Ty, and the target altitude Ta are retrieved.

The satellite longitude Sx, the satellite latitude Sy, and the satellite altitude Sa obtained in step 102 and the target longitude Tx, the target latitude Ty, and the target altitude Ta obtained in step 103 are compared with each other, step 104. In step 105, it is determined if a difference (namely, the longitude error Ex, the latitude error Ey, and the altitude error Ea) exists between the two sets of coordinates. A negative answer of the judgment step 105 indicates that the antenna 2 is currently in correct orientation and no adjustment or re-orientation is necessary. The process goes back to step 101 again to start a new cycle for continuous and dynamic control of the orientation of the antenna in order to ensure the antenna 2 is always in the correct orientation.

On the other hand, if the answer of the judgment step 105 is positive, then in step 106, the correction control signals Cx, Cy, and Ca are generated and applied to the drive circuits 67, 68, 69, which in step 107 control the adjusting mechanisms 71, 72, 73 to re-orient the antenna 2 in order to reduce the errors Ex, Ey, Ea to a desired level, such as approximately zero. In step 108, it is determined if an operation stop instruction is received from for example a user. If positive, then the process stops, otherwise the process goes back to step 101 to start a new cycle of adjustment.

The present invention allows a satellite disc antenna carried in a moving vehicle to make adjustment of the orientation of the antenna with respect to a selected commercial satellite in order to obtain optimum reception of the electromagnetic signals transmitted from the satellite. Thus, program quality shown in a play device can be maintained excellent regardless the moving of the vehicle. Apparently, the present invention can be of a great application in for example satellite program reception in fore example a long distance bus, a passenger marine vehicle and personal amusement.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A device for orienting a satellite antenna carried in a movable carrier, which receives an electromagnetic signal from at least one satellite and, in response thereto, provides a satellite signal comprised of a program component that is retrieved by a playing device to play a program contained therein and a coordinate component, the device comprising:

a satellite tracking system comprising:

a position processor that receives the satellite signal and retrieves at least one satellite coordinate contained in the coordinate component of the satellite signal, a channel setting/selection unit adapted to be used by a user to set/select at least one program channel having an associated target coordinate, a register that stores the target coordinate, a comparator that receives the satellite coordinate from the position processor and the target coordinate from the register and compares the satellite coordinate with the target coordinate to generate an error, and a microprocessor that receives the error and in response thereto issue a correction control signal; and an antenna adjusting device adapted to mechanically and operatively couple to the antenna, comprising an adjusting mechanism that receives the correction control signal and operates in accordance with the correction control signal to orient the antenna.

2. The device as claimed in claim 1, wherein the coordinate component of the satellite signal comprises satellite longitude, satellite latitude, and satellite altitude.

3. The device as claimed in claim 1, wherein the target coordinate comprises target longitude, target latitude, and target altitude.

4. The device as claimed in claim 1, wherein the satellite tracking system further comprises a memory containing data of at least one program channel adapted to be selected by a user.

5. The device as claimed in claim 4, wherein the memory comprises a section adapted to store a program channel set by the user with the channel setting/selection unit.

6. The device as claimed in claim 1, wherein the error generated by the comparator comprises a longitude error, a latitude error, and an altitude error.

7. The device as claimed in claim 6, wherein the correction control signal comprises a longitude-associated correction control signal, a latitude-associated correction control signal, and an altitude-associated correction control signal.

8. A device for orienting a satellite antenna carried in a movable carrier, which receives an electromagnetic signal from at least one satellite and, in response thereto, provides a satellite signal comprised of a program component that is retrieved by a playing device to play a program contained therein and a coordinate component, the device comprising:

a satellite tracking system comprising:

a position processor that receives the satellite signal and retrieves at least one satellite coordinate contained in the coordinate component of the satellite signal, a memory adapted to store data of at least one pre-established program channel having an associated target coordinate, a comparator that receives the satellite coordinate from the position processor and the target coordinate from the memory and compares the satellite coordinate with the target coordinate to generate an error, and a microprocessor that receives the error and in response thereto issue a correction control signal; and an antenna adjusting device adapted to mechanically and operatively couple to the antenna, comprising an adjusting mechanism that receives the correction control signal and operates in accordance with the correction control signal to orient the antenna.

9. The device as claimed in claim 8, wherein the coordinate component of the satellite signal comprises satellite longitude, satellite latitude, and satellite altitude.

10. The device as claimed in claim 8, wherein the target coordinate comprises target longitude, target latitude, and target altitude.

11. The device as claimed in claim 8, wherein the satellite tracking system further comprises a channel selection for selecting one program channel from the memory.

12. The device as claimed in claim 8, wherein the error generated by the comparator comprises a longitude error, a latitude error, and an altitude error.

13. The device as claimed in claim 12, wherein the correction control signal comprises a longitude-associated correction control signal, a latitude-associated correction control signal, and an altitude-associated correction control signal.

* * * * *